US006966288B2

(12) United States Patent
Simpson

(10) Patent No.: US 6,966,288 B2
(45) Date of Patent: Nov. 22, 2005

(54) LOCK PIN WITH CENTRIFUGALLY OPERATED RELEASE VALVE

(75) Inventor: Roger T. Simpson, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/968,295

(22) Filed: Oct. 19, 2004

(65) Prior Publication Data

US 2005/0103295 A1 May 19, 2005

Related U.S. Application Data

(60) Provisional application No. 60/520,771, filed on Nov. 17, 2003.

(51) Int. Cl.[7] ..... F01L 1/34
(52) U.S. Cl. ..... 123/90.17; 123/90.15; 123/90.31
(58) Field of Search ..... 123/90.15, 90.17, 123/90.31

(56) References Cited

U.S. PATENT DOCUMENTS 4,421,074 A * 12/1983 Garcea et al. ..... 123/90.15
6,761,138 B2 * 7/2004 Takahashi et al. ..... 123/90.15

FOREIGN PATENT DOCUMENTS

| | | | |
|---|---|---|---|
| EP | 1221540 | 7/2002 | ..... F01L 1/344 |
| EP | 1355046 | 12/2003 | ..... F01L 1/344 |
| JP | 06307209 | 11/1994 | ..... F01L 1/34 |
| JP | 09100704 | 4/1997 | ..... F01L 1/34 |
| JP | 2001227311 | 8/2001 | |

* cited by examiner

*Primary Examiner*—Thomas Denion
*Assistant Examiner*—Zelalem Eshete
(74) *Attorney, Agent, or Firm*—Brown & Michaels, PC; Greg Dziegielewski

(57) ABSTRACT

A variable camshaft timing system for an internal combustion engine comprising a housing having an outer circumference for accepting drive force, a rotor for connection to a camshaft coaxially located within the housing capable of rotation to shift the relative angular position of the housing and the rotor, a locking pin, and a centrifugal valve. The locking pin is slidably located and radially moveable in a radial bore from a locked position in which the inner end fits into the recess defined by the housing, locking the relative angular position of the rotor and housing, to an unlocked position in which the inner end does not engage the receiving hole defined by the housing. The centrifugal valve is in fluid communication with an inlet line coupled directly to an engine oil supply controlling flow of oil to the locking pin.

10 Claims, 4 Drawing Sheets

HIGH SPEED

LOW SPEED

LOCK PIN WITH CENTRIFUGALLY OPERATED RELEASE VALVE

REFERENCE TO RELATED APPLICATIONS

This application claims an invention which was disclosed in Provisional Application No. 60/520,771, filed Nov. 17, 2003, entitled "LOCK PIN WITH CENTRIFUGALLY OPERATED RELEASED VALVE." The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable cam timing systems. More particularly, the invention pertains to a variable cam timing system where a centrifugally operated valve controls the oil flow to a locking pin.

2. Description of Related Art

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a housing with one or more vanes, mounted to the end of the camshaft, surrounded by a housing with the vane chambers into which the vanes fit. It is possible to have the vanes mounted to the housing, and the chambers in the housing, as well. The housing's outer circumference forms the sprocket, pulley, or gear accepting drive force through a chain, belt, or gears, usually from the camshaft, or possibly from another camshaft in a multiple-cam engine.

In some engines, the locking pins don't remain seated in the locked position, preventing movement of the rotor relative to the housing, until the engine speed is great enough. Other times, the locking pin does not lock at the appropriate time during engine shutdown, allowing the vane to oscillate within the chambers of the phaser and cause damage.

Some phasers use locking pins that utilize the aid of centrifugal force to lock the housing relative to the rotor, as shown in JP2001227311A, "Lock Pin With Centrifugally Operated Release Valve." JP2001227311A shows a locking pin and the centrifugal force that acts on the pin during idle to aid in locking the pin quickly. The locking pin in this reference is controlled by a hydraulic force that acts on the locking pin with the aid of any centrifugal force present.

SUMMARY OF THE INVENTION

A variable camshaft timing system for an internal combustion engine comprising a housing having an outer circumference for accepting drive force, a rotor for connection to a camshaft coaxially located within the housing capable of rotation to shift the relative angular position of the housing and the rotor, a locking pin, and a centrifugal valve.

The locking pin is slidably located a radial bore, comprising a body having a diameter adapted to a fluid-tight fit in the radial bore, and an inner end toward the housing adapted to fit in a recess defined by the housing. The locking pin is radially moveable in a radial bore from a locked position, in which the inner end fits into the recess defined by the housing, locking the relative angular position of the rotor and housing, to an unlocked position, in which the inner end does not engage the receiving hole defined by the housing.

The centrifugal valve is in fluid communication with an inlet line coupled directly to an engine oil supply controlling flow of oil to the locking pin. When engine speed is high, the oil pressure from the inlet line is great enough to open the centrifugal valve and thus open the locking pin. When engine speed is low or during engine shutdown, the centrifugal valve is closed and the locking pin remains in the locked position ensuring that the phaser is in the correct position for the next engine start.

DETAILED DESCRIPTION OF THE INVENTION

Figure 1:
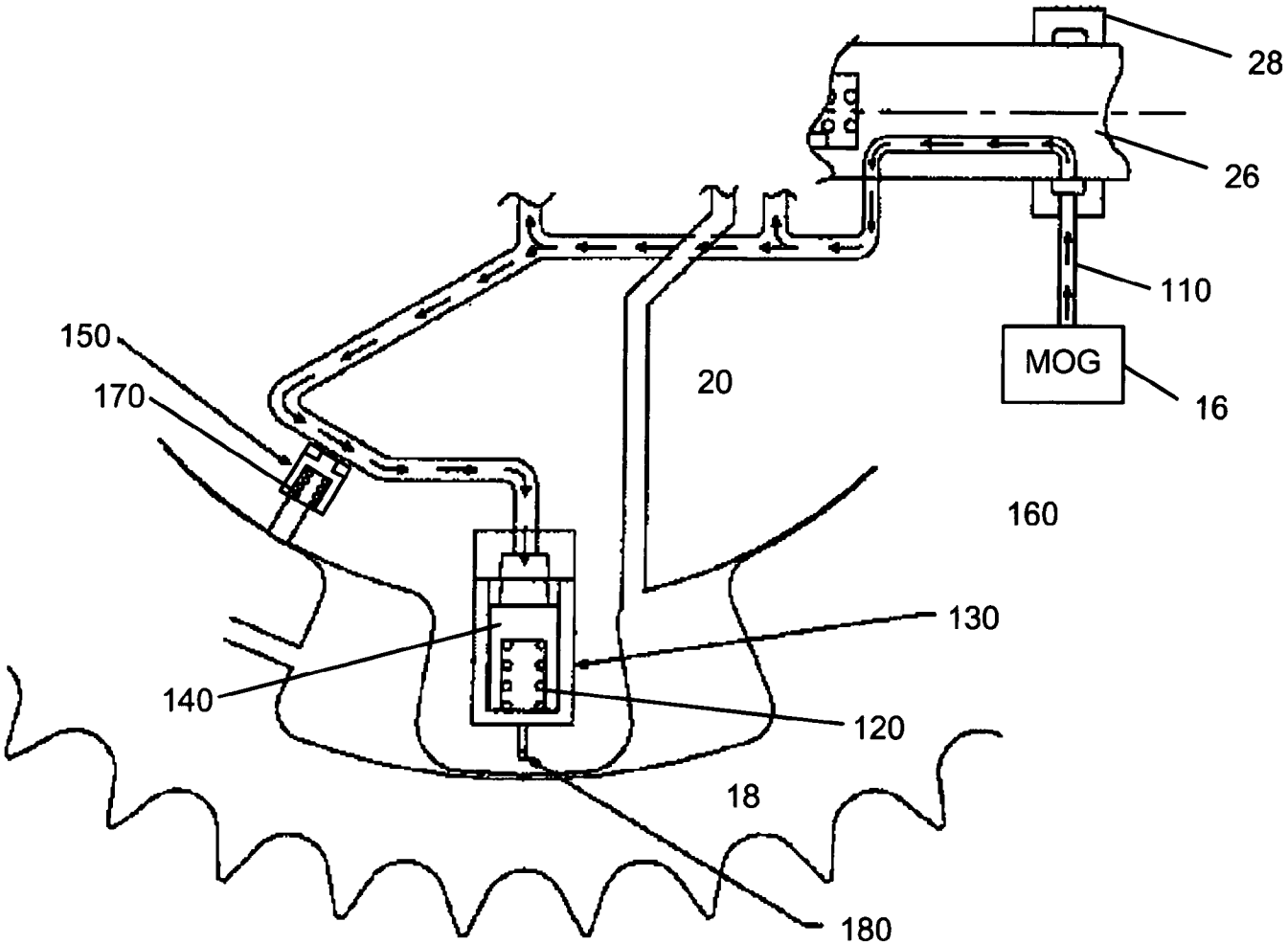
FIG. 1 shows a schematic view of an embodiment when the engine operates at high speeds.

In a variable cam timing (VCT) system, the timing gear on the camshaft is replaced by a variable angle coupling known as a "phaser", having a rotor connected to the camshaft and a housing connected to (or forming) the timing gear, which allows the camshaft to rotate independently of the timing gear, within angular limits, to change the relative timing of the camshaft and crankshaft. The term "phaser", as used here, includes the housing and the rotor, and all of the parts to control the relative angular position of the housing and rotor, to allow the timing of the camshaft to be offset from the crankshaft. In any of the multiple-camshaft engines, it will be understood that there would be one phaser on each camshaft, as is known to the art.

Referring to FIGS. 1 through 4, the phaser operating fluid, illustratively in the form of engine lubricating oil is introduced into the phaser by way of a common inlet line 110 connected to the main oil gallery (MOG) 16. Inlet line 110 enters the phaser through bearing 28 of the camshaft 26. The inlet line 110 supplies oil to the spool (not shown) and to locking pin 130.

The locking pin 130 is present in a radial bore 160 in the rotor 20. Locking pin 130 has a body 140 with a diameter that is fluid tight fit in the bore 160. Spring 120 biases the locking pin 130 within the radial bore 160 to engage the housing 18. A vent 180 is present at one end of the locking pin. The locking pin may be present in the rotor or the housing and received by the other. Along inlet line 110, prior to locking pin 130, a centrifugal valve 150 is present.

Figure 3:
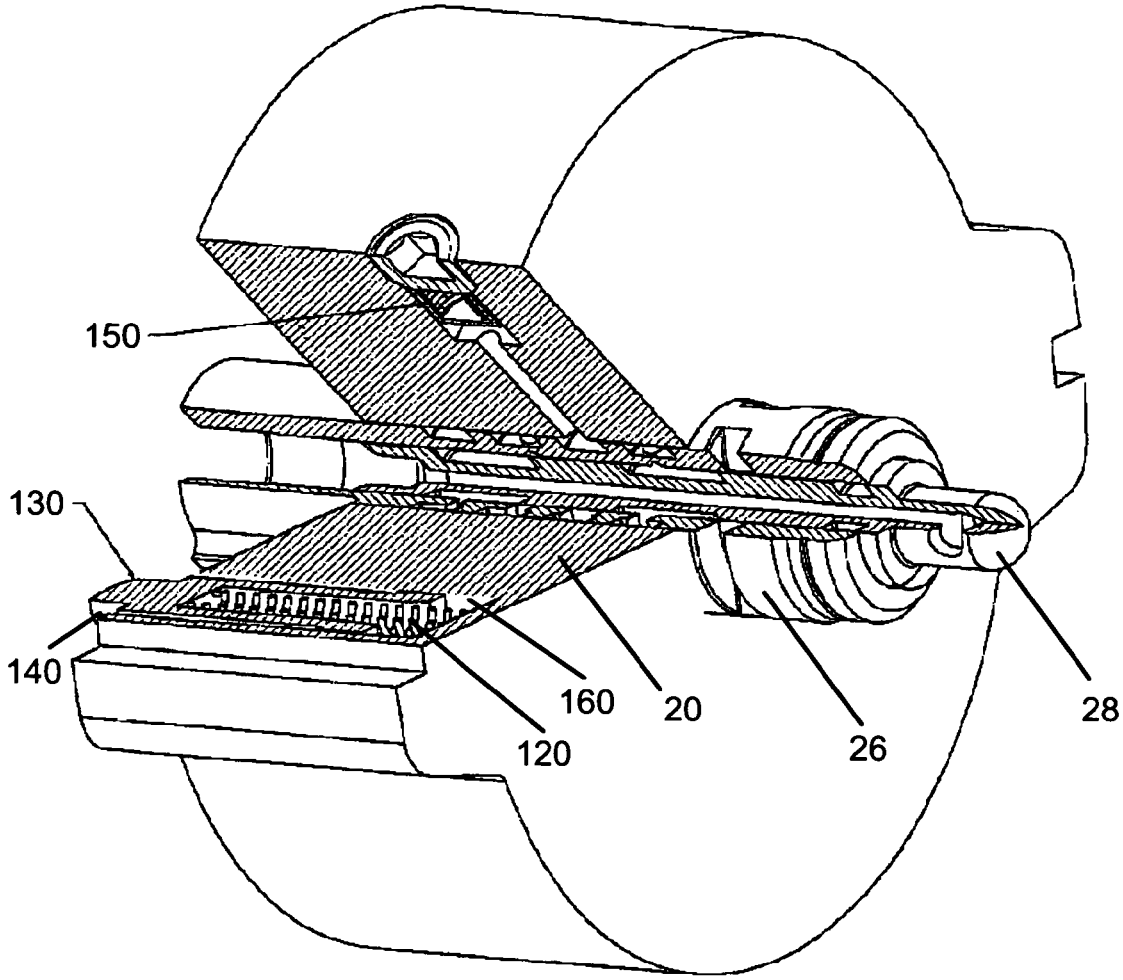
FIG. 3 shows a cutaway view of an embodiment when the engine operates at high speeds.

As shown in FIGS. 1 and 3, the centrifugal valve 150 comprises a cylinder and a spring and operates by using the increasing inertial forces on the cylinder to push against spring 170 as the phaser increases in speed. As the speed increases (i.e. high speed), the centrifugal valve 150 opens and allows oil to flow to the locking pin 130 to release it. By using the centrifugal valve 150, the locking pin 130 and the phaser remain in a locked position, until the engine speed is high enough.

Figure 2:
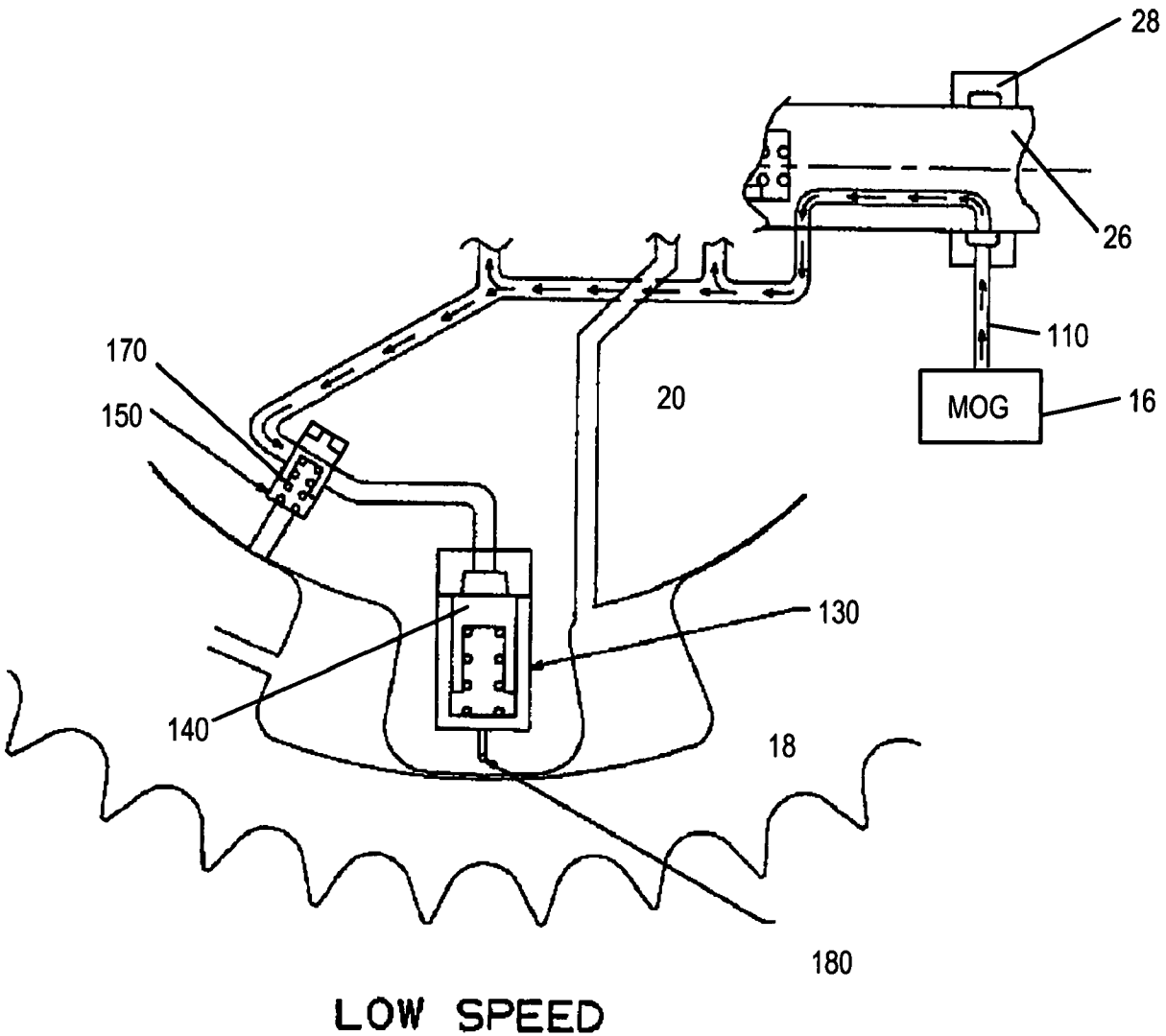
FIG. 2 shows a schematic view of an embodiment when the engine operates at low speeds.
Figure 4:
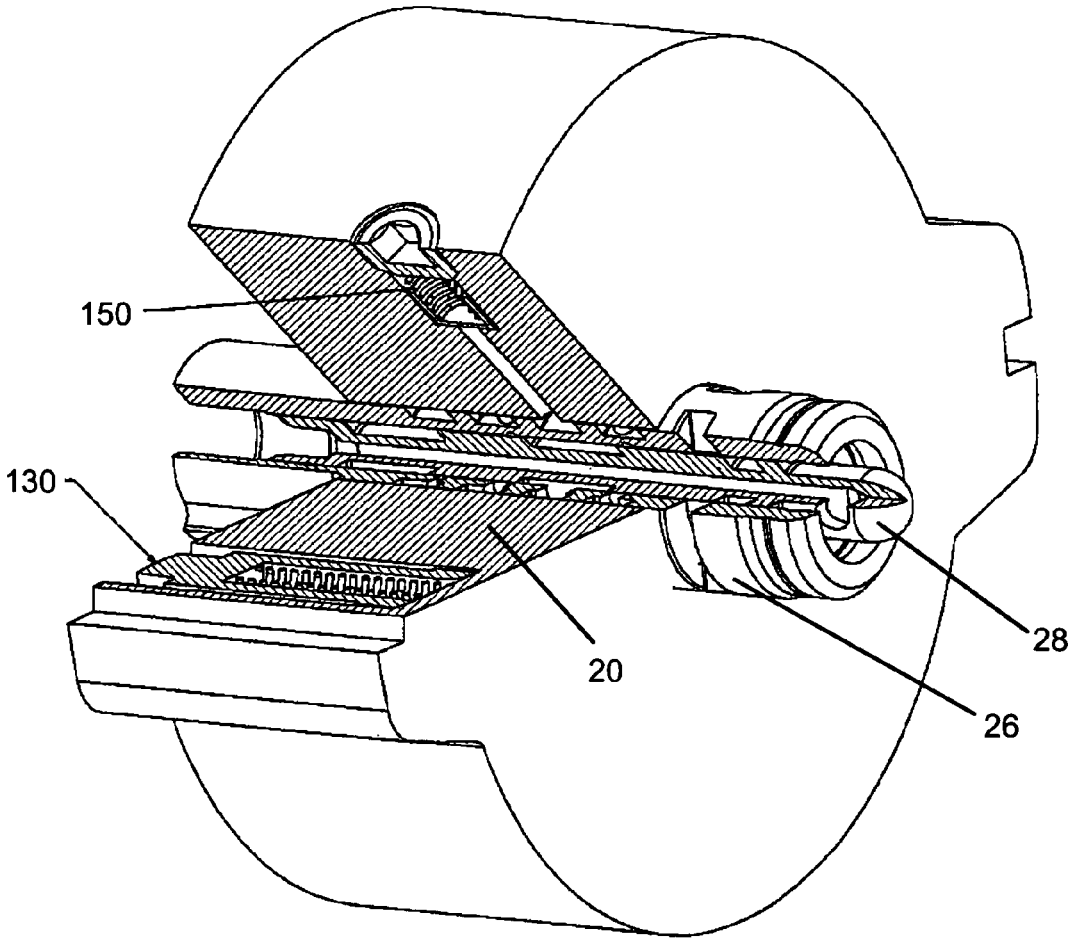
FIG. 4 shows a cutaway view of an embodiment when the engine operates at low speeds.

As shown in FIGS. 2 and 4, during low speeds or engine shutdown, the centrifugal valve 150 is closed, due to the lack of the sufficient oil pressure, blocking the flow of oil to locking pin 130. By requiring that there by sufficient oil pressure to open centrifugal valve prior to the oil flowing to the locking pin, the locking pin remains closed when the engine has already shutdown and a small amount of oil pressure may still be present. The presence of the centrifugal valve also allows the phaser to be locked in the correct position before the engine completely stops spinning and remain in this position for the next engine start.

The centrifugal valve 150 and locking pin 130 is not limited to a specific phaser type and may be used for a cam torque actuated (CTA), torsion assist (TA), or oil pressure actuated (OPA) phaser. In a CTA phaser, the variable cam timing system uses torque reversals in the camshaft caused by the forces of opening and closing engine valves to move the vane. Control valves are present to allow fluid flow from chamber to chamber causing the vane to move, or to stop the flow of oil, locking the vane in position. The CTA phaser has oil input to make up for losses due to leakage but does not use engine oil pressure to move the phaser.

In OPA or TA phasers, the engine oil pressure is applied to one side of the vane or the other, in the retard or advance chamber, to move the vane. Motion of the vane due to forward torque effects is permitted.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable camshaft timing system for an internal combustion engine comprising:

a housing having an outer circumference for accepting drive force;

a rotor for connection to a camshaft coaxially located within the housing capable of rotation to shift the relative angular position of the housing and the rotor;

a locking pin slidably located in a radial bore, comprising a body having a diameter adapted to a fluid-tight fit in the radial bore, and an inner end toward the housing adapted to fit in a recess defined by the housing, the locking pin being radially moveable in the bore from a locked position in which the inner end fits into the recess defined by the housing, locking the relative angular position of the rotor and housing, to an unlocked position in which the inner end does not engage the receiving hole defined by the housing; and a centrifugal valve in fluid communication with an inlet line coupled directly to an engine oil supply controlling flow of oil to the locking pin.

2. The variable camshaft timing system of claim 1, wherein the locking pin further comprises a spring located in the radial bore opposite the inner end of the locking pin, urging the locking pin radially inward toward the locked position.

3. The variable camshaft timing system of claim 1, wherein the centrifugal valve further comprises a spring and a cylinder.

4. The variable camshaft timing system of claim 1, wherein the centrifugal valve is opened when engine speed is high.

5. The variable camshaft timing system of claim 1, wherein the centrifugal valve is closed when engine speed is low or the engine is shutdown.

6. A variable camshaft timing system for an internal combustion engine comprising:

a housing having an outer circumference for accepting drive force;

a rotor for connection to a camshaft coaxially located within the housing capable of rotation to shift the relative angular position of the housing and the rotor;

a locking pin slidably located in a radial bore, comprising a body having a diameter adapted to a fluid-tight fit in the radial bore, and an inner end toward the housing adapted to fit in a recess defined by the housing, the locking pin being radially moveable in the bore from a locked position in which the inner end fits into the recess defined by the housing, locking the relative angular position of the rotor and housing, to an unlocked position in which the inner end does not engage the receiving hole defined by the housing; and a centrifugal valve located in the rotor in fluid communication with an inlet line coupled directly to an engine oil supply controlling flow of oil to the locking pin.

7. The variable camshaft timing system of claim 6, wherein the locking pin further comprises a spring located in the radial bore opposite the inner end of the locking pin, urging the locking pin radially inward toward the locked position.

8. The variable camshaft timing system of claim 6, wherein the centrifugal valve further comprises a spring and a cylinder.

9. The variable camshaft timing system of claim 6, wherein the centrifugal valve is opened when engine speed is high.

10. The variable camshaft timing system of claim 6, wherein the centrifugal valve is closed when engine speed is low or the engine is shutdown.

* * * * *